US007673997B2

(12) United States Patent
Hwang et al.

(10) Patent No.: US 7,673,997 B2
(45) Date of Patent: Mar. 9, 2010

(54) CONTROL PANEL ASSEMBLY FOR LAUNDRY MACHINE

(75) Inventors: Sung Gi Hwang, Changwon-si (KR); Ju Han Yoon, Changwon-si (KR); Seong Kyu Kim, Changwon-si (KR); Seon Il Heo, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/850,334

(22) Filed: Sep. 5, 2007

(65) Prior Publication Data

US 2008/0062673 A1 Mar. 13, 2008

(30) Foreign Application Priority Data

Sep. 7, 2006 (KR) ..... 10-2006-0086137

(51) Int. Cl.
*G01D 11/28* (2006.01)

(52) U.S. Cl. ..... 362/27; 340/815.4; 340/815.45; 340/815.47; 340/815.49; 340/815.55; 362/23; 362/26; 362/29; 362/85; 362/91

(58) Field of Classification Search ..... 362/23, 362/26, 27, 29, 85, 91; 340/815.4, 815.45, 340/815.47, 815.49, 815.55
See application file for complete search history.

(56) References Cited

U.S. PATENT DOCUMENTS 5,741,058 A * 4/1998 Suzuki et al. ..... 362/27
2003/0016125 A1* 1/2003 Lang et al. ..... 340/425.5
2005/0073823 A1* 4/2005 Engelmann et al. ..... 362/23
2006/0016096 A1 1/2006 Kim
2007/0119484 A1* 5/2007 Kwon et al. ..... 134/58 R

FOREIGN PATENT DOCUMENTS

GB 2116297 A * 9/1983

OTHER PUBLICATIONS

Chinese Office Action dated Jul. 17, 2009 with translation.

* cited by examiner

*Primary Examiner*—Sharon E Payne
*Assistant Examiner*—Mary Zettl
(74) *Attorney, Agent, or Firm*—KED & Associates LLP

(57) ABSTRACT

The present invention relates to a control panel assembly in which a light emitted from a single lamp is prevented from being dispersed nearby. A control panel assembly for a laundry machine, the control panel assembly includes a lamp supporter in which a plurality of lamps are installed to display functions selected by a user; a deco formed corresponding to the plurality of the lamps, the deco including a plurality of light-emitting holes through which a light emitted from each of the lamps passes; a light window including a light dispersion preventing part provided between the lamp supporter and the deco to prevent the light emitted from each of the lamps from being emitted through the other light-emitting holes except a single light-emitting hole corresponding each of the lamps.

7 Claims, 4 Drawing Sheets

CONTROL PANEL ASSEMBLY FOR LAUNDRY MACHINE

CROSS REFERENCE TO RELATED APPLICATION

This application claims the benefit of the Patent Korean Application No. 10-2006-0086137, filed on Sep. 7, 2006, which are hereby incorporated by reference as if fully set forth herein.

BACKGROUND OF THE DISCLOSURE

1. Field of the Disclosure

The present invention relates to a control panel assembly for a laundry machine. More particularly, the present invention relates to a control panel assembly for a laundry machine, which can prevent a light emitted from a single lamp from being dispersed nearby.

2. Discussion of the Related Art

Laundry machines are typically configured of a control panel provided on an upper portion of a front thereof and the control panel includes an input part and a display part. A user inputs operational functions by using the input part and washing information of the laundry machine is displayed on the display part.

The input part includes plural buttons and a rotation switch.

A user operates the buttons and the rotation switch to select a washing time, washing method, drying method and spinning method. Also, various kinds of information including a washing process condition and a remaining time may be displayed on the display part by using letters or images.

In reference to FIGS. 1 and 2, a structure of a conventional control panel assembly for a laundry machine will be explained.

A conventional control panel assembly includes a control panel 10, a rotation switch 50, a lamp supporter 40, a rotary knob 30 and a deco 20. The rotation switch 50 includes an encoder 52 and an encoder shaft 51. The lamp supporter 40 supports LED lamps for emitting a light. The rotation switch 30 is coupled to the encoder shaft 51. The deco 20 guides the light emitted from the LED lamp.

The control panel 10 covers a circuit substrate 60 in which the encoder 50 is installed and it has a through hole 11 through which the rotary knob 30 coupled to the encoder 51 passes.

As the user rotates the rotary knob 30 coupled to the encoder shaft 51, the encoder 52 creates a signal and sends the signal to a micom (not show).

The deco 20 is ring-shaped and an engaging part is projected from a rear circumferential surface of the deco 20 in a radial direction. A hook 12 is formed at a rear surface of the control panel 10. As a result, the engaging part of the deco 20 is fixedly engaged to the hook 12.

On the other hand, plural light-emitting holes 21 are formed at predetermined portions of the deco 20, corresponding to the LED lamps and the light emitted through the through holes 21 can show user selected functions.

In addition, a light window 70 is provided at a rear surface of the deco 20 to guide the light emitted from the LED lamps. The light window 70 is formed of transparent material and light-emitting protrusions 72 that passes the light-emitting holes 21, respectively, are arranged at the light window 70 a predetermined distance.

As a result, if the user rotates the rotary knob 30 to select a particular function, a corresponding LED lamp 41 emits a light and the light is dispersed through the light-emitting protrusions 72 formed at the light window 70.

However, as shown in FIG. 3, the light emitted from the single LED lamp 41 is emitted not only through the single corresponding through-hole 21 but also through the light window 70. As a result, the light is dispersed and emitted through neighboring light-emitting holes in the conventional control panel for a laundry machine.

Thus, there is a problem that a user fails to recognize the selected function clearly.

SUMMARY OF THE DISCLOSURE

Accordingly, the present invention is directed to control panel assembly for a laundry machine.

An object of the present invention is to provide a control panel assembly for a laundry machine that can prevent a light emitted form a corresponding lamp of a selected function by a user from being dispersed nearby.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a control assembly for a laundry machine, the control panel assembly includes a lamp supporter in which a plurality of lamps are installed to display functions selected by a user; a deco formed corresponding to the plurality of the lamps, the deco including a plurality of light-emitting holes through which a light emitted from each of the lamps passes; a light window including a light dispersion preventing part provided between the lamp supporter and the deco to prevent the light emitted from each of the lamps from being emitted through the other light-emitting holes except a single light-emitting hole corresponding each of the lamps.

It is preferable that the light window includes a plurality of light-emitting protrusions formed at predetermined positions corresponding to the plurality of the light-emitting holes, respectively.

The light dispersion preventing part may include a light transmittance preventing member provided between each neighboring light-emitting protrusions to prevent a light emitted from each of the lamps from being incident on the light window.

The light dispersion preventing part may include a light dispersion preventing hole formed between each neighboring light-emitting protrusions to allow the light emitted from each of the lamp to pass through.

It is preferable that a rear surface of the light-emitting protrusion is formed with a substantially large surface roughness.

It is preferable that the plurality of lamps are arranged in a circumferential direction.

The light window may be formed of acryl material.

According to the present invention, the laundry machine may include a washer, dryer and dehydrating apparatus and variations of them.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
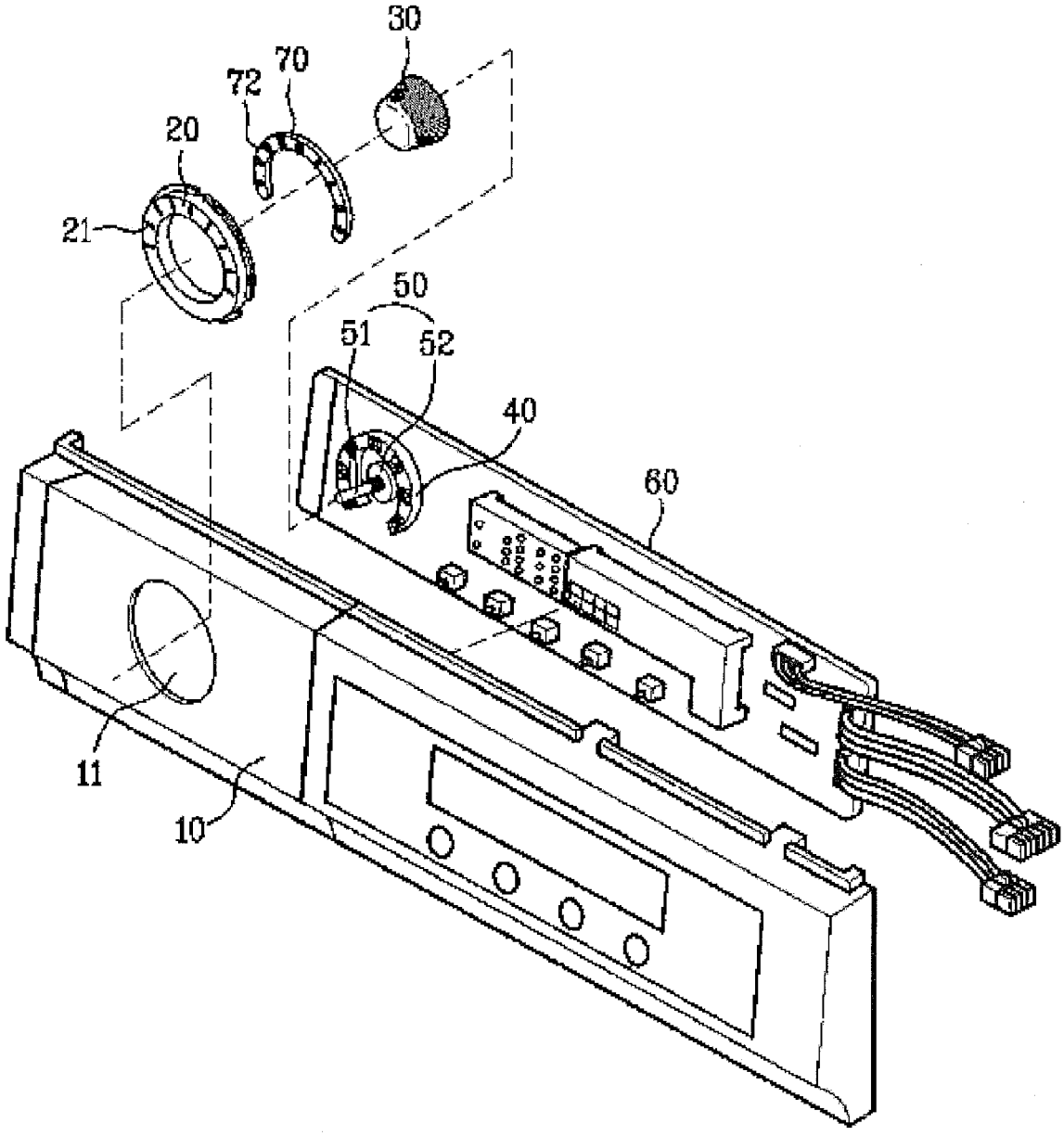
FIG.1 Related Art
FIG. 1 is an exploded perspective view illustrating a conventional control assembly for a laundry machine.
Figure 2:
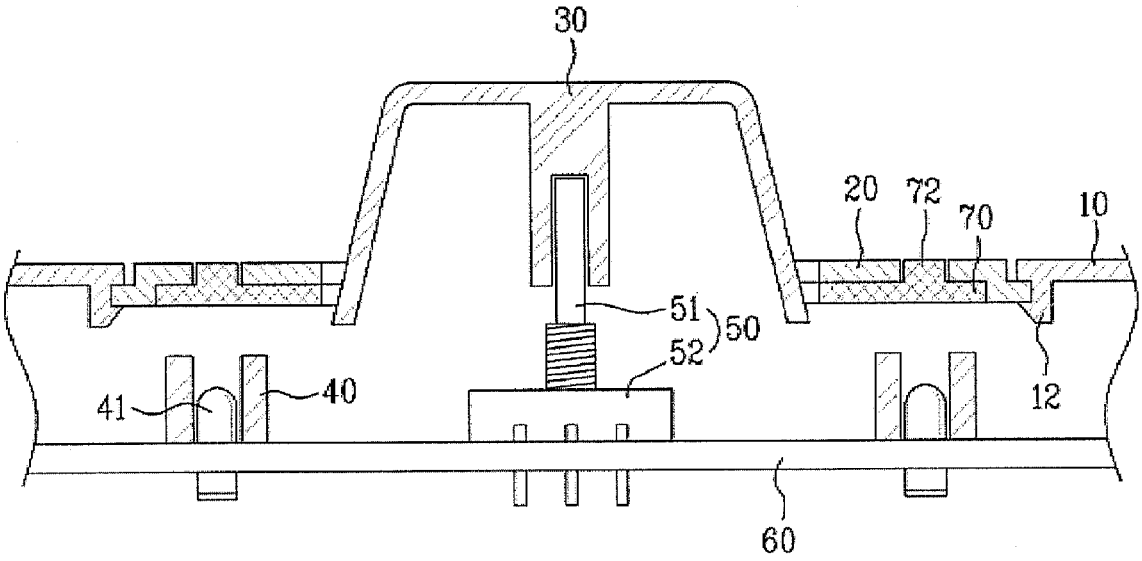
FIG.2 Related Art
FIG. 2 is a sectional view illustrating the conventional control panel assembly shown in FIG. 1.
Figure 3:
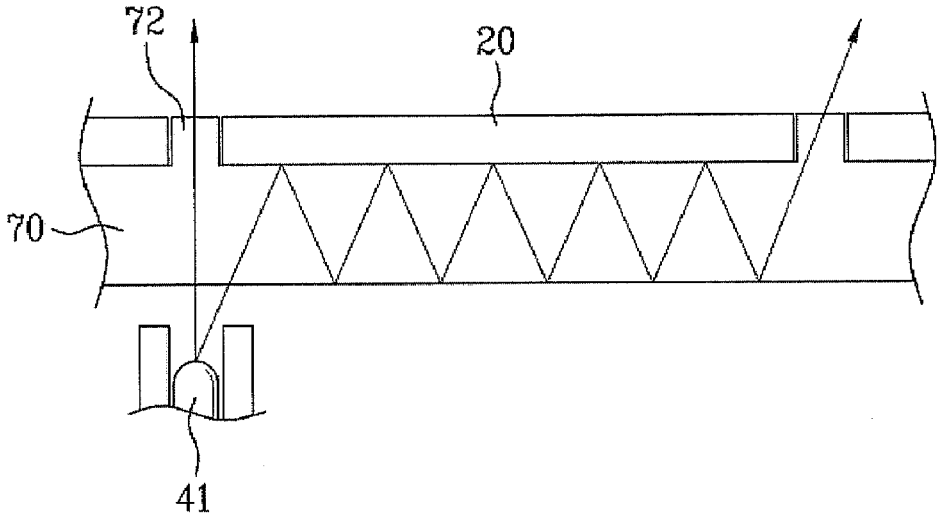
FIG.3 Related Art
FIG. 3 is a diagram illustrating the conventional control panel assembly emitting a light.
Figure 4:
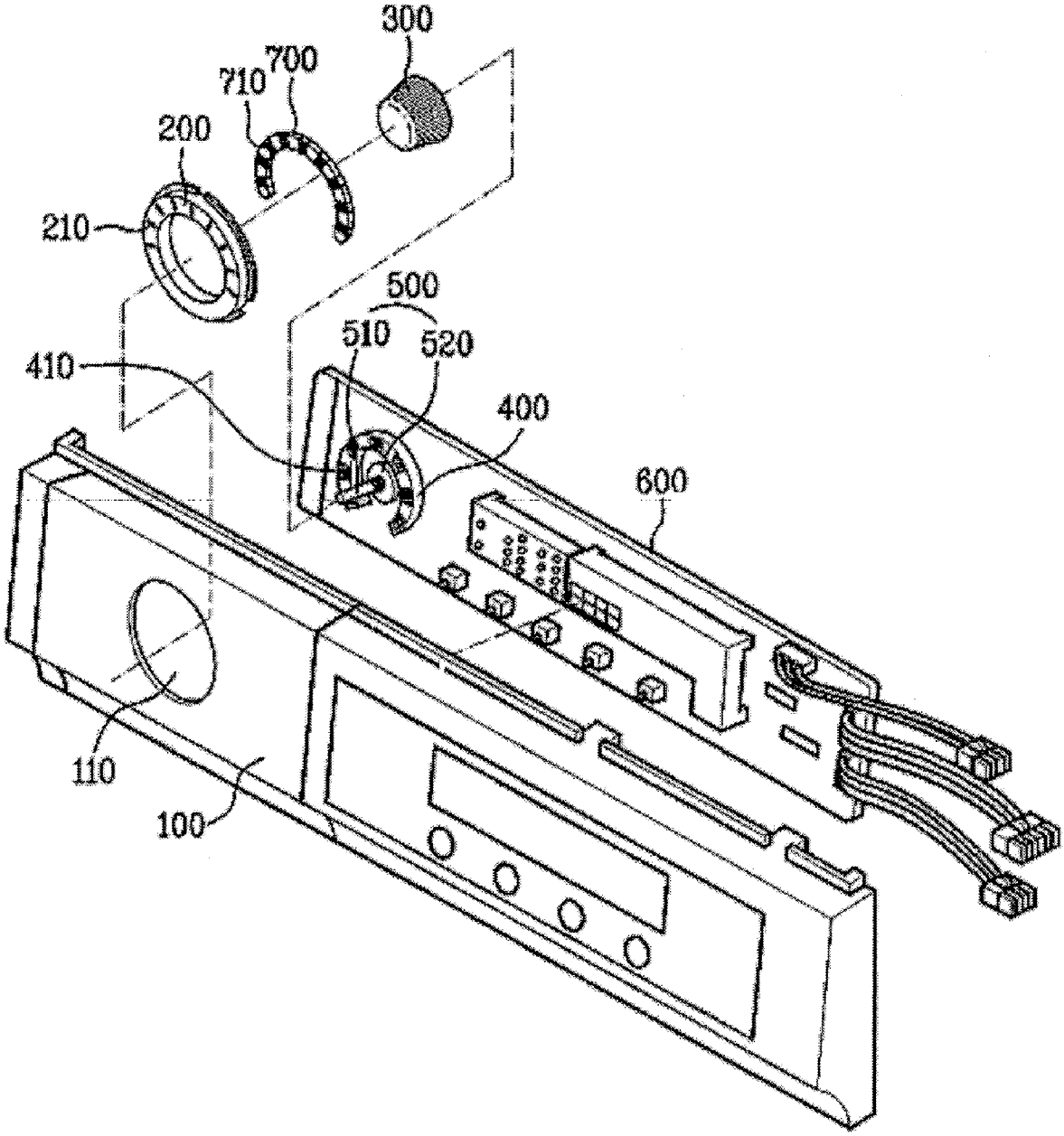
FIG. 4 is an exploded perspective view illustrating a control panel assembly for a laundry machine according to the present invention.

As shown in FIG. 4, a control panel assembly for a laundry machine according to an embodiment of the present invention includes a plurality of lamps 410, a lamp supporter 400 for supporting the lamps, a rotation switch 500, a rotary knob 300 coupled to the rotation switch 500 to rotate together, a deco 200 provided along a circumferential direction of the rotary knob 300 and a light window 700 having a light dispersion preventing part.

The lamp 410 emits a light and may be any kinds of lamps including LED, EL or variation of them that can emit lights.

The lamp 410 may be provided in plural as many as functions and modes selectable by a user. That is, it is preferable that a light is emitted from a lamp corresponding to each selected function or mode whenever a user rotates the rotary knob 300.

In addition, the lamps 410 may be arranged along a circumferential direction of the rotary knob 300 but they are not limited thereto. The lamps 410 may be arranged linearly.

It is not necessary that the lamp 410 should be operated by the rotary knob 300. For example, the lamps 410 may be operated by selection buttons.

The lamp supporter 400 supports the plurality of the lamps 410 and also it guides the light emitted from the lamp 410 forward by covering the lamp 410.

This embodiment presents that the rotation switch 500 includes an encoder 520 and an encoder shaft 510.

The encoder 520 transmits a pulse number, which is changeable based on a rotation degree of the rotary knob 300 in a right or left direction, to a micom (not shown) via a circuit substrate 600. The encoder shaft 510 helps the encoder 520 to be coupled to the rotary knob 300.

The rotary knob 300 is exposed outside a control panel 100 defining a front of the laundry machine, such that a user can select wished functions by rotating the rotary knob 300.

The deco 200 covers an outer circumferential surface of the rotary knob 300 and a front surface of the deco 200 is projected outside the control panel 100.

It is preferable that light-emitting holes are formed at predetermined portions of the deco 200, corresponding to the lamps 410, respectively.

The light window 700 helps the light emitted from the lamps 410 to be dispersed uniformly, such that the light is emitted through the light-emitting holes 210 outside.

Figure 5:
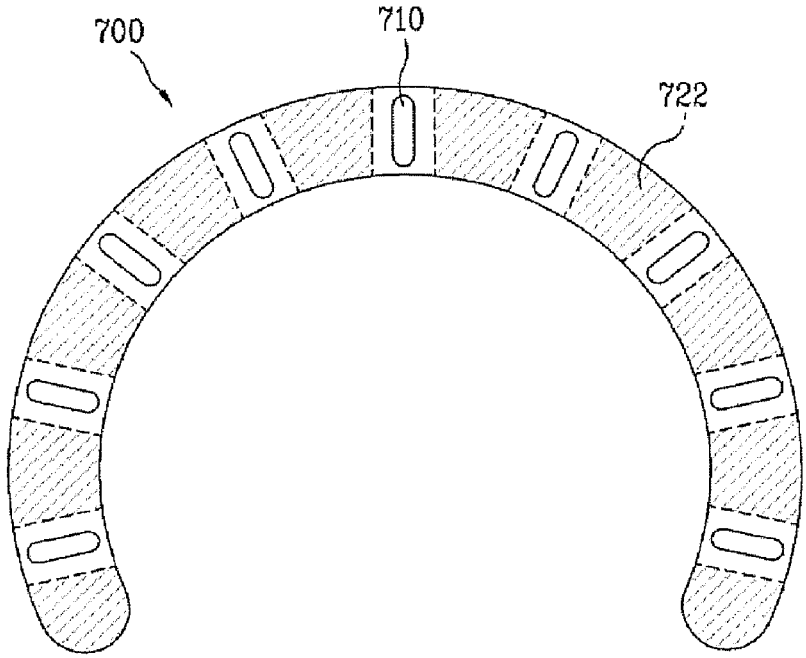
FIG. 5 is a plane view illustrating a light transmittance preventing member of a light window according to the present invention.
Figure 6:
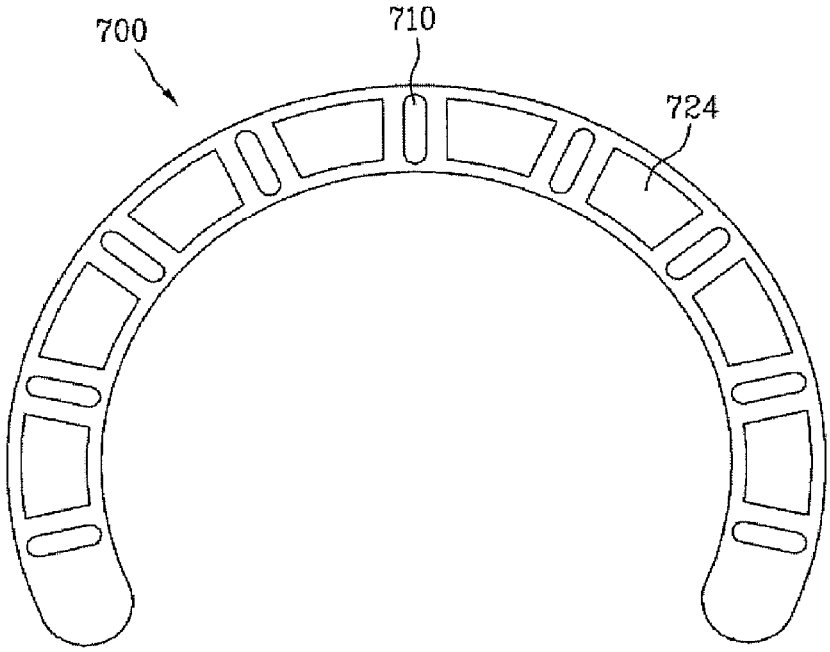
FIG. 6 is a plane view illustrating a light dispersion preventing hole of the light widow according to the present invention.

In reference to FIGS. 5 and 6, the light window 700 will be explained in detail.

The light window 700 may be fabricated in a corresponding shape of the lamp supporter 400 and it may be provided between the deco 200 and the lamp supporter 400. Especially, it is preferable that the light window 700 is coupled to a rear surface of the deco 200.

It is also preferable that the light window 700 is formed of acryl material moldable smoothly with good light transmittance.

The light window 700 may include a light-emitting protrusion 710 formed corresponding to each light-emitting hole 210 of the deco 700 and the light-emitting protrusion 710 may be inserted in the light-emitting hole 210.

Since the lamp 410 is installed in rear of the light-emitting protrusion 710, a light is emitted from the selected single lamp 410 as a user rotating the rotary knob 300 and the light is emitted through the light-emitting protrusion 710.

A light dispersion preventing part 722 and 724 is provide between each neighboring light-emitting protrusion 710 to prevent the light emitted from the selected single lamp 410 from being emitted through the other light-emitting holes except the single corresponding light-emitting hole.

This embodiment presents that a light transmittance preventing member 722 or a light dispersion preventing hole 724 may be provided as the light dispersion preventing part.

In reference to FIG. 5, the light transmittance preventing member 722 will be explained first.

It is preferable that the light emitted from a single lamp 410 is emitted outside through a single corresponding light-emitting hole 210 formed in front of the single lamp 410 but the light might be emitted through the other light-emitting holes.

Specifically, the light emitted from the single lamp 410 may be incident in an oblique direction with respect to the light window 700 and the light proceeds in the light window 700 to be emitted through the other light-emitting holes. In other words, the light window 700 might be a wave guide.

Thus, the light incident on the light window 700 in the oblique direction should be shut off to allow the light to be incident in a front direction.

For that, it is preferable that a predetermined member having good reflexibility is provided at the rear surface of the light window 700, specifically, between each neighboring light-emitting protrusions 710, and this is what the light transmittance preventing member 722 is employed for.

Next, in reference to FIG. 6, the light dispersion preventing hole 724 will be explained.

While the light transmittance preventing member 722 shuts off a part of the light incident on the light window 700, the light dispersion preventing hole 724 allows the light to be incident on the light window 700 and prevents the light from being dispersed sideward through the light window 700.

Specifically, the light dispersion preventing hole 724 is formed between each neighboring light-emitting protrusions 710 of the light window 700 and it allows a part of the light emitted from the single lamp 410 to pass through the light dispersion preventing holes 724, such that the light can be reflected or absorbed at a rear surface of the deco 200. As a result, lights may not be dispersed into the other light-emitting holes near the corresponding single light-emitting hole of the single lamp 410 and the light is emitted only through the corresponding light-emitting hole positioned in front of the single lamp 410.

On the other hand, a surface of the light-emitting protrusion 710 is formed relatively rough and when the light emitted from the lamp 410 is incident through a portion of the light-emitting protrusion 710 having the surface roughness, the light is reflected roughly and the light is dispersed uniformly.

As mentioned above, in the control panel assembly for a laundry machine, the light emitted from the single lamp displaying a selected function is prevented from being dispersed nearby. As a result, a user can recognize the selected function more clearly.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A control panel assembly for a laundry machine, the control panel assembly comprising:

a lamp supporter in which a plurality of lamps are installed to display functions selected by a user;

a deco formed corresponding to the plurality of the lamps, the deco including a plurality of light-emitting holes through which light emitted from respective ones of the lamps passes;

a light window provided between the lamp supporter and the deco, the light window including:

a light dispersion preventing part to prevent the light emitted from each one of the lamps from being emitted through the light-emitting holes corresponding to other ones of the lamps and allowing light to pass through a single light-emitting hole corresponding to said each one of the lamps, wherein the light dispersion preventing part comprises at least one light dispersion preventing hole that penetrates the light window and is positioned between said single light-emitting hole and a light-emitting hole corresponding to one of the other ones of the lamps, and a plurality of light-emitting protrusions formed at predetermined positions corresponding to the plurality of the light-emitting holes, respectively, wherein a rear surface of each of the light-emitting protrusions is formed with a roughness sufficient to cause light to be dispersed and reflected.

2. The control panel assembly of claim 1, wherein the plurality of lamps are arranged in a circumferential direction.

3. The control panel assembly of claim 1, wherein the light window is formed of acryl material.

4. The control panel assembly of claim 1, wherein the rear surface of each of the light-emitting protrusions is formed with a roughness sufficient to cause light to be dispersed in a uniform manner.

5. A laundry machine including a control panel assembly, wherein the control panel assembly comprising:

a lamp supporter in which a plurality of lamps are installed to display functions selected by a user;

a deco formed corresponding to the plurality of the lamps, the deco including a plurality of light-emitting holes through which light emitted from respective ones of the lamps passes;

a light window provided between the lamp supporter and the deco, the light window including:

a light dispersion preventing part to prevent the light emitted from each one of the lamps from being emitted through the light-emitting holes corresponding to other ones of the lamps and allowing light to pass through a single light-emitting hole corresponding to said each one of the lamps, wherein the light dispersion preventing part comprises at least one light dispersion preventing hole that penetrates the light window and is positioned between said single light-emitting hole and a light-emitting hole corresponding to one of the other ones of the lamps, and a plurality of light-emitting protrusions formed at predetermined positions corresponding to the plurality of the light-emitting holes, respectively, wherein a rear surface of each of the light-emitting protrusions is formed with a roughness sufficient to cause light to be dispersed and reflected.

6. The control panel assembly of claim 1, wherein the light dispersion preventing hole prevents light passing through said single light-emitting hole from propagating sideways through the light window and out through the light-emitting hole corresponding to said one of the other ones of the lamps.

7. The machine of claim 5, wherein the rear surface of each of the light-emitting protrusions is formed with a roughness sufficient to cause light to be dispersed in a uniform manner.

* * * * *